US005235791A

United States Patent [19]

Yaguchi

[11] Patent Number: 5,235,791

[45] Date of Patent: Aug. 17, 1993

[54] DECK PLATE

[75] Inventor: Hide Yaguchi, Tokyo, Japan

[73] Assignee: Yaguchi Kenzai Khakko Co., Ltd., Tokyo, Japan

[21] Appl. No.: 875,687

[22] Filed: Apr. 28, 1992

[51] Int. Cl.[5] ..... E04B 5/02; E04C 2/04

[52] U.S. Cl. ..... 52/649.1; 52/319; 52/414; 52/600; 52/694

[58] Field of Search ..... 52/319, 250, 414, 600, 52/602, 690, 692, 694, 335, 336, 337, 649.1, 650.1, 650.2, 630

[56] References Cited

U.S. PATENT DOCUMENTS

| | | | |
|---|---|---|---|
| 1,134,955 | 4/1915 | Knox | 52/690 |
| 2,192,183 | 3/1940 | Deutsch | 52/600 |
| 2,639,010 | 5/1953 | Weber | 52/336 |
| 2,900,056 | 8/1959 | Greulich | 52/336 |
| 3,313,074 | 4/1967 | Huntley | 52/414 |
| 3,345,793 | 10/1967 | Cvikl | 52/650.2 |
| 3,748,720 | 7/1973 | Versteeg | 52/649.1 |
| 5,072,565 | 12/1991 | Wilnau | 52/600 |

FOREIGN PATENT DOCUMENTS

| | | | |
|---|---|---|---|
| 2114494 | 4/1979 | Fed. Rep. of Germany | 52/600 |
| 61-65111 | 5/1986 | Japan . | |
| 317033 | 12/1956 | Switzerland | 52/692 |
| 1196880 | 7/1970 | United Kingdom | 52/602 |
| 2085502 | 4/1982 | United Kingdom | 52/600 |

*Primary Examiner*—Michael Safavi

*Attorney, Agent, or Firm*—Wenderoth, Lind & Ponack

[57] ABSTRACT

A deck plate includes a number of trusses arranged in parallel and rigidly secured to a base member, each of the trusses includes one upper reinforcing bar and two lower reinforcing bars arranged to provide a triangle transversely, and two corrugated reinforcing bars each having a series longitudinal triangle waves and adapted to be rigidly secured to the upper reinforcing bar and to the corresponding lower reinforcing bar respectively, so that the truss has a triangle shape transversely and can stand independently. The deck plate is constructed by standing a number of trusses on the base member parallelly and at regular intervals and then the trusses are rigidly secured to the base member in a form that the trusses are set into the grooves on the surface of the base member, in the case that truss does not have a lower bent out extending parts, and pressed by weight bars or welding the trusses onto the base member, in the case that truss has a lower bent out extending parts, using or not using the suspending members.

4 Claims, 7 Drawing Sheets

DECK PLATE

BACKGROUND OF THE INVENTION

1. Field of the Invention

The present invention relates generally to the field of the architectural or structural constructions, and more particularly it relates to a deck plate that may be used as a form or reinforcement for a reinforced concrete floor, for example, in a building.

2. Description of the Prior Art

A conventional deck plate, described in Japan unexamined Utility Model publication No. 61-65111, includes reinforcing trusses which are rigidly secured to the upper side of a base member. The truss according to this prior art as described therein has a plane-like configuration. Specifically, the truss includes an upper reinforcing bar and a vertically spaced low reinforcing bar parallel thereto, and a corrugated reinforcing bar arranged between the upper and lower reinforcing bars and having a series of triangular waves in the longitudinal direction of said upper and lower reinforcing bars. Every top apex of the corrugated reinforcing bar is rigidly secured to the underside of the upper reinforcing bar, and every bottom apex is rigidly secured to the upper side of the lower reinforcing bar so that the truss has a plane-like configuration. In this conventional deck plate, the trusses each having a plane-like configuration are secured to the base member by suspending members. The suspending members, which are parallel and are spaced at regular intervals on the base member, are rigidly secured to the upper side of the upper reinforcing bar of each truss wherefrom the trusses are suspended vertically, and the suspending members are rigidly secured to the surface of the base member at parts thereof which are in contact with the surface of the base member.

The conventional deck plate has several disadvantages since the truss cannot stand independently owing to its plane-like configuration. It cannot provide adequate mechanical strength, and may be used only at limited locations. In addition, in a conventional deck plate, the planar truss cannot be manufactured in an automated line because each of the top apexes and bottom apexes of the corrugated reinforcing bar must be rigidly secured to the underside of the upper reinforcing bar and to the upperside of the lower reinforcing bar, respectively. Further, in a conventional deck plate, it is a serious problem and it is difficult to erect the truss on the base member and to secure the truss to the base member because the truss cannot stand independently owing to its plane-like configuration. In a conventional deck plate, it is necessary to suspend the truss from the suspending members with the upper side of the upper reinforcing bar of each truss rigidly secured to the suspending members. The suspending members must then be secured to the surface of the base member in order to erect the truss on the base member. In this case, the suspending member is secured to the upper reinforcing bar of the truss in order to suspend the truss, while said suspending member, at the other part, is further secured to the surface of the base member. Therefore, the conventional deck plate cannot be manufactured in an automated line because of the necessity of these securing steps to erect and secure the trusses, and because these trusses cannot stand independently on the base member owing to their plane-like configurations.

SUMMARY OF THE INVENTION

The present invention has been developed to solve the above-mentioned disadvantages. It is accordingly the object of the present invention to provide a deck plate that includes a truss formed by three longitudinal reinforcing bars and two corrugated reinforcing bars so that the truss has a triangular shape in cross section whereby the truss can stand independently. Thus, the disadvantages of the prior art deck plate can be eliminated.

In its one specific form, the deck plate includes a number of trusses that are arranged parallel and at regular intervals on a base member, and are rigidly secured to the base member, and is characterized in that each of said trusses comprise an upper longitudinal reinforcing bar and two lower longitudinal reinforcing bars, said upper longitudinal reinforcing bar and said two lower longitudinal reinforcing bars being arranged in a triangle with the upper reinforcing bar at the top and the two lower reinforcing bars at the bottom side of the triangle. The first corrugated longitudinal reinforcing bar, having a series of longitudinal triangular waves, is rigidly secured to said upper reinforcing bar and to one of said lower reinforcing bars with the inside of each of upper apexes of said first corrugated reinforcing bar being rigidly secured to one side of said upper reinforcing bar and the outside of the intermediate part of said first corrugated reinforcing bar between its upper apex and bottom apex being rigidly secured to the inner side of one of said lower reinforcing bars. The second corrugated longitudinal reinforcing bar having a series of longitudinal triangular waves is rigidly secured to said upper reinforcing bar and to the other said lower reinforcing bar with the inside of each of upper apexes of said second corrugated reinforcing bar between its upper apex and bottom apex being rigidly secured to the inner side of the other said lower reinforcing bar. The base member has a number of grooves extending parallel and spaced apart at regular intervals in its surface in correspondence with a series of the bottom apexes of the first and second corrugated reinforcing bars of the trusses. The deck plate is constructed by erecting a number of trusses on the surface of the base member in parallel and at regular intervals with each of the series of the bottom apexes of the first and second corrugated reinforcing bars of each truss being set in the corresponding grooves in the surface of the base member, and by placing a number of longitudinal reinforcing bars as a weight on the trusses and on the base member with the longitudinal reinforcing bar extending across the line of trusses at portions thereof where each bottom apex of the first corrugated reinforcing bar and corresponding bottom apex of the second corrugated reinforcing bar are set in the corresponding grooves in the surface of the base member, so that the trusses are rigidly secured to the base member.

In another specific form, the deck plate includes a number of trusses that are arranged parallel and at regular intervals on a base member, and are rigidly secured to the base member, and is characterized in that each of said trusses comprise an upper longitudinal reinforcing bar and two lower longitudinal reinforcing bars, said upper longitudinal reinforcing bar and said two lower longitudinal reinforcing bars being arranged in a triangle with the upper reinforcing bar at the top and the two lower reinforcing bars at the bottom of the triangle. The first corrugated longitudinal reinforcing bar, having a series of longitudinal triangular waves, is rigidly secured to said upper reinforcing bar and to one of said lower reinforcing bars with the inside of each of the upper apexes of said first corrugated reinforcing bar being rigidly secured to one side of said upper reinforcing bar and the inside of the intermediate part of said first corrugated reinforcing bar between its upper apex and bottom apex being rigidly secured to the outer side of one of said lower reinforcing bars. The second corrugated longitudinal reinforcing bar, having a series of longitudinal triangular waves, is rigidly secured to said upper reinforcing bar and to the other lower reinforcing bar with the inside of each of upper apexes of said second corrugated reinforcing bar being rigidly secured to the other side of said upper reinforcing bar and the inside of the intermediate part of said second corrugated reinforcing bar between its upper apex and bottom apex being rigidly secured to the outer side of the other said lower reinforcing bar. These first and second corrugated reinforcing bars are bent out at a location intermediate the position at which said first and second corrugated reinforcing bars are secured to each respective lower reinforcing bars and each bottom apex so that each of the bottom apexes of said first and second corrugated reinforcing bars extend outwardly from the bent out portion. The deck plate is constructed by standing a number of trusses on the surface of the base member in parallel and at regular intervals and securing each of the undersides of the bent out extending parts of said first and second corrugated longitudinal reinforcing bars to the surface of said base member.

The bottom apexes of the first and second corrugated reinforcing bars may extend outwardly in a plane parallel with the surface of the base member.

In an alternative to the preceding forms, the deck plate includes a number of trusses that are arranged in parallel and at regular intervals on a base member, and are rigidly secured to the base member by a number of suspending reinforcing bars, and is characterized in that each of said trusses comprise an upper longitudinal reinforcing bar and two lower longitudinal reinforcing bars, said upper longitudinal reinforcing bar and said two lower longitudinal reinforcing bars being arranged in a triangle with the upper reinforcing bar at the top and the two lower reinforcing bars at the bottom of the triangle. The first corrugated longitudinal reinforcing bar has a series of longitudinal triangular wave sand is rigidly secured to said upper reinforcing bar and to one of said lower reinforcing bars with the inside of each of upper apexes of said first corrugated reinforcing bar being rigidly secured to one side of said upper reinforcing bar and the inside of the intermediate part of said first corrugated reinforcing bar between its upper apex and bottom apex being rigidly secured to the outer side of one of said lower reinforcing bars. The second corrugated longitudinal reinforcing bar, having a series of longitudinal triangular waves, is rigidly secured to said upper reinforcing bar and to the other said lower reinforcing bar with the inside of each of upper apexes of said second corrugated reinforcing bar being rigidly secured to the other side of said upper reinforcing bar and the inside of the intermediate part of said second corrugated reinforcing bar between its upper apex and bottom apex being rigidly secured to the outer side of the other said lower reinforcing bar. The suspending reinforcing bar has a triangular shape which corresponds to that of the truss. And the deck plate is constructed by standing a number of trusses on the surface of the base member in parallel and at regular intervals, placing a number of suspending reinforcing bars across said trusses and in parallel at regular intervals, and securing each suspending reinforcing bar to said trusses and to the surface of said base member with each said suspending reinforcing bar being rigidly secured to said upper longitudinal reinforcing bar of the truss at the upper side of said upper longitudinal reinforcing bar and with said suspending reinforcing bars being rigidly secured to the surface of said base member.

In all of the forms, all of the members may be joined together by means of welds, for example.

The deck plate according to the present invention includes a truss formed by one upper reinforcing bar and two lower reinforcing bars arranged in a transversely triangular configuration, and two corrugated reinforcing bars rigidly secured to the upper and lower reinforcing bars. Therefore, the truss of the present invention can stand independently. That is to say, in the conventional deck plate, means such as suspending members are necessary to erect the truss, which has a plane-like configuration, on the base member. However, in the present invention, the truss can stand on the base member without any suspending members. Therefore, the deck plate of the present invention provides increased mechanical strength and allows for a broader range of applications.

Further, in the conventional deck plate, the work or operations to secure the suspending member to the upper reinforcing bar of the trusses and the work or operations to secure said suspending member to the surface of the base member are necessary because the trusses cannot stand independently owing to their plane-like configurations. In the present invention, these securing steps are eliminated. In the present invention, the truss having a transversely triangular configuration can stand independently. In the embodiment in which the truss does not have the lower bent-out extending parts, the deck plate of the present invention is constructed by standing a number of trusses on the surface of the base member in parallel and at regular intervals with each of a series of the bottom apexes of the first and second corrugated reinforcing bars of each truss being set into corresponding grooves in the surface of the base member, and placing a number of longitudinal reinforcing bars as a weight on the trusses and on the base member with the longitudinal reinforcing bars extending across the trusses at locations where each bottom apex of the first corrugated reinforcing bar and corresponding bottom apex of the second corrugated reinforcing bar are set into the corresponding grooves in the surface of the base member, whereby the trusses are rigidly secured to the base member. In the embodiment in which the truss has the lower bent-out extending parts, said lower bent-out extending parts are placed on the base member and secured to the base member.

Accordingly, the present invention is easy to manufacture in an automated line. Few manufacturing steps of the deck plate are required, and the manufacturing time of the deck plate is accordingly short. Also, because the deck plate of the present invention can be manufactured in an automated line, the deck plate can be manufactured under high production control with a high degree of precision.

BRIEF DESCRIPTION OF THE DRAWINGS

Those and other objects, features, and advantages of the present invention will become apparent from the detailed description of several preferred embodiments that follow by reference to the accompanying drawings, in which.

DETAILED DESCRIPTION OF THE PREFERRED EMBODIMENTS

(EXAMPLE 1)

Referring to FIG. 1 through FIG. 5, a preferred embodiment of the present invention will now be described.

Figure 1:
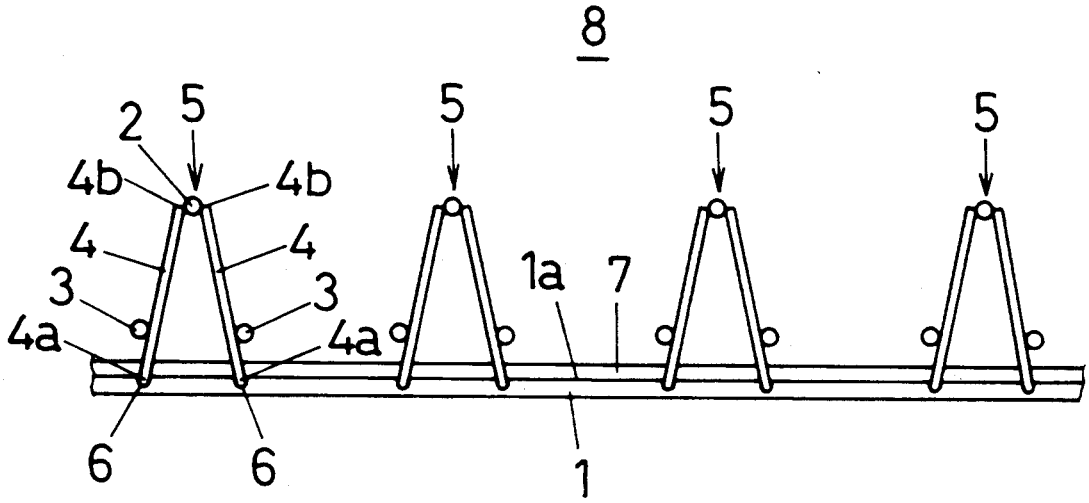
FIG. 1 is a side elevation of the first preferred embodiment of the present invention.
Figure 3:
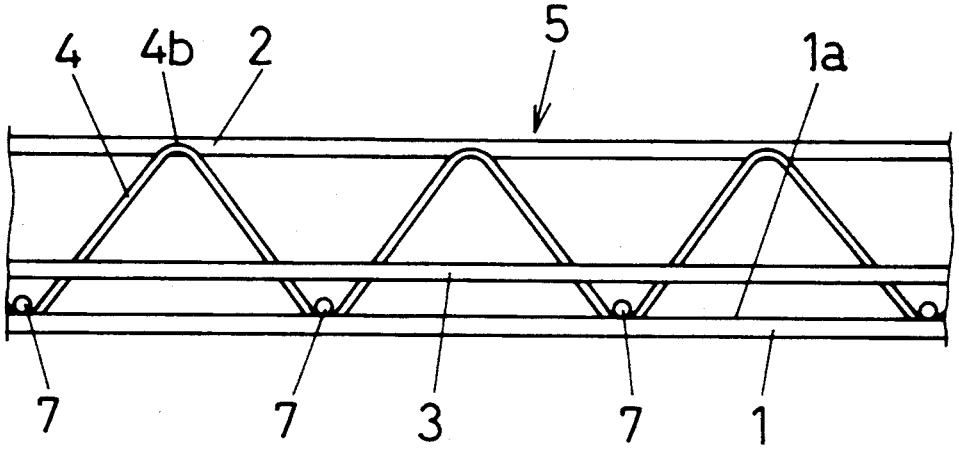
FIG. 3 is a front elevation of the embodiment of FIG. 1 with some parts omitted.
Figure 4:
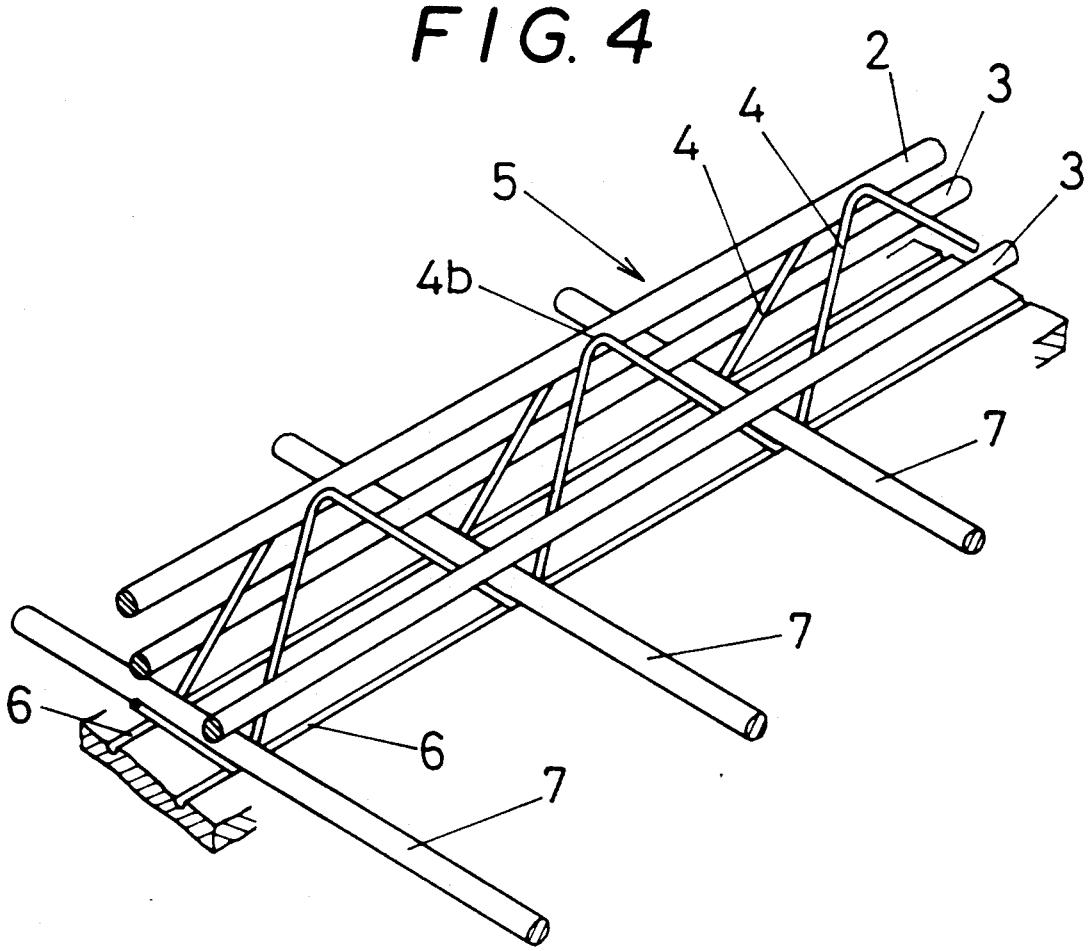
FIG. 4 is a perspective view of the embodiment of FIG. 1 with some parts omitted.

One upper reinforcing bar 2 and two lower reinforcing bars 3, 3 are arranged in a triangle with the upper reinforcing bar 2 at the top and the two lower reinforcing bars 3, 3 at the bottom. Those bars are placed above a base member 1. Two corrugated reinforcing bars 4, 4 each having a series of longitudinal triangular waves as shown in FIGS. 3 and 4 are rigidly secured to the upper reinforcing bar and to the lower reinforcing bars, respectively, in such a way that they form a triangular truss 5 extending transversely (FIG. 1). Each of the corrugated reinforcing bars 4, 4 includes top apex 4*b* and bottom apex 4*a*. The inside of the top apexes 4*b*, 4*b* may be rigidly secured to the sides of the upper reinforcing bar 2, respectively, and a predetermined intermediate part of each of the bars 4, 4 on its outside between the top apex 4*b* and bottom apex 4*a* may be rigidly secured to the inner side of a respective one of the lower bars 3, 3 (FIG. 1).

The predetermined intermediate part of the bar 4 on its outside part at which the outerside of the bar 4 is secured to the inner side of a respective lower bar 3 is located 30 mm above the surface 1*a* of the base member 1, for example (FIG. 1).

Figure 2:
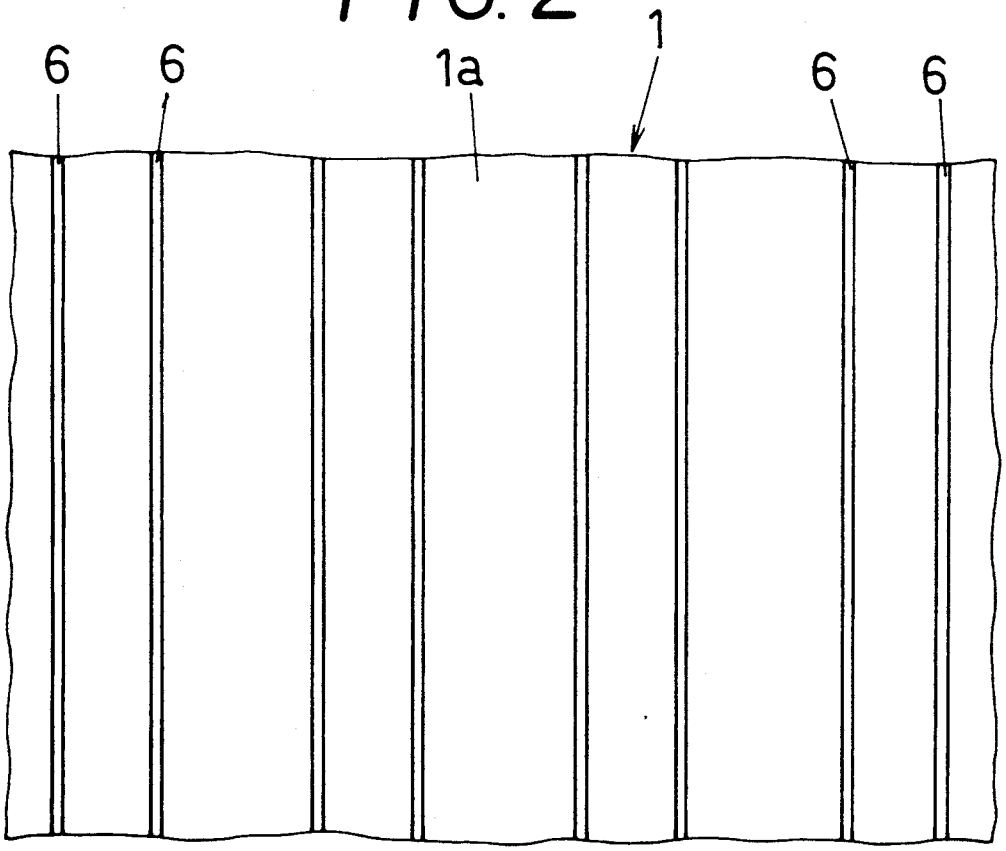
FIG. 2 is a plane view of the base member of the embodiment of FIG. 1.

The base member 1 has a number of grooves 6, 6 extending parallel and at regular intervals in its surface 1*a* in correspondence with the series of the bottom apexes 4*a*, 4*a* of the first and second corrugated reinforcing bars 4, 4 of the truss 5 (FIG. 2).

Several trusses each having the identical structures as described above are erected on the base member 1 in parallel and at regular intervals along the length of the member 1 by setting the series of the bottom apexes 4*a*, 4*a* of the first and second corrugated reinforcing bars 4, 4 of the truss 5 into the corresponding grooves 6, 6 in the surface 1*a* of the base member 1 (FIG. 1). And then, a number of longitudinal reinforcing bars 7, 7 as a weight is placed on the trusses, 5, 5 and on the base member 1 with the longitudinal reinforcing bars, 7, 7 lying on the surface 1*a* across the line of trusses 5, 5 at the portion where each bottom apex 4*a* of the second corrugated reinforcing bar 4 are set into the grooves 6, 6 so that the truss 5 is pressed on the base member 1 and rigidly secured to the base member 1. In this way the deck plate 8 is constructed (FIGS. 1, 3 and 4).

The deck plate 8 as constructed above may be used in the same manner as the conventional deck plate is. A particular mold is provided into which raw concrete is to be placed. The deck plate 8 is then placed on the mold, with the upper reinforcing bar 2, lower reinforcing bars 3, 3 and base member 1 being fixed at their respective ends to the respective members of a particular structure (such as main reinforcing members and other reinforcing bars), thereby forming an integral structure. Then, raw concrete is placed into the mold, and is allowed to cure and solidify. Finally, the deck plate 8, coupled with the molded concrete, forms a floor in a building (not shown).

In the embodiment described so far, the truss 5 includes the corrugated reinforcing bars 4 rigidly secured to the inner side of the corresponding lower reinforcing bars 3. Alternatively, the corrugated reinforcing bars 4 may be rigidly secured to the outer side of the corresponding lower bars 3. In this case, a truss 5*a* and deck plate 8*a* are shown in FIG. 5.

Figure 5:
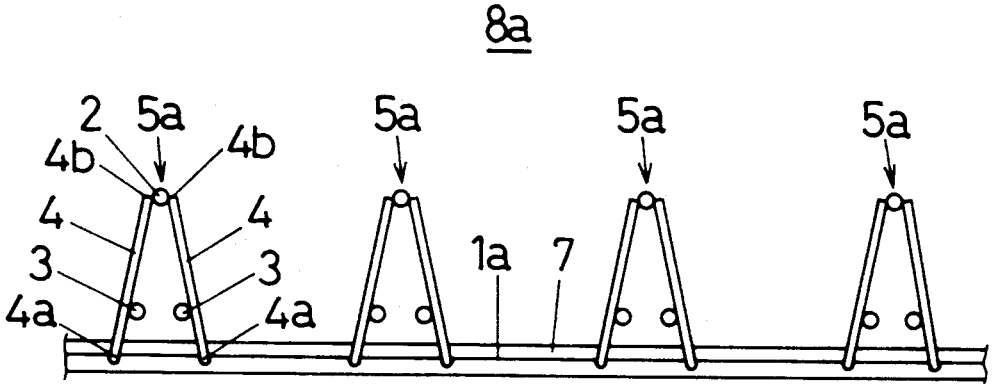
FIG. 5 is a side elevation of the second preferred embodiment of the present invention.

In FIG. 5, the same numeral is assigned to the same member of the deck plate as shown in FIGS. 1 to 4.

In the above-described embodiment, the trusses can stand independently on the base member, and so suspending members are not necessary.

(EXAMPLE 2)

Referring to FIG. 6 through FIG. 9, another preferred embodiment of the present invention will now be described.

Figure 6:
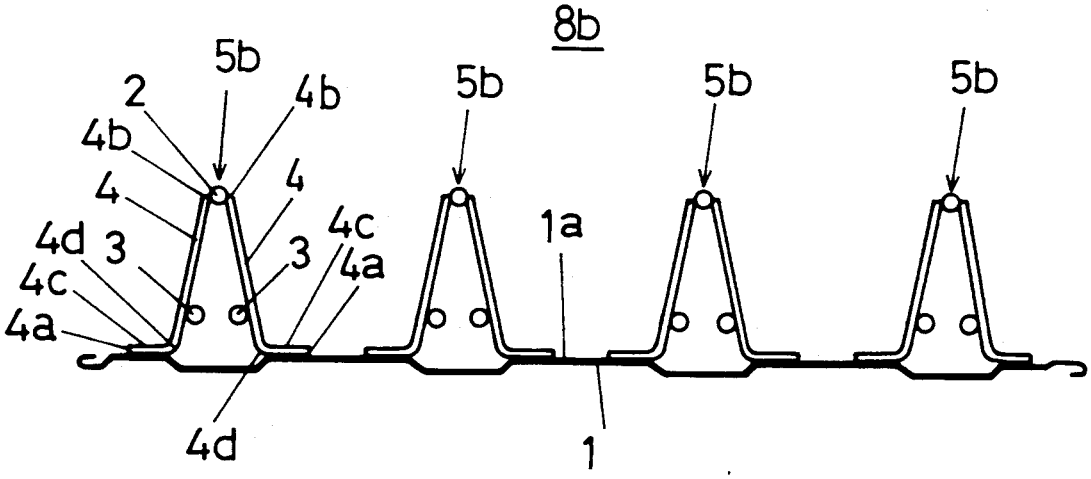
FIG. 6 is a side elevation of the third preferred embodiment of the present invention.

The construction is generally similar to that in the preceding embodiment, and includes one upper reinforcing bar 2 and two lower reinforcing bars 3, 3 arranged in a triangle with the upper reinforcing bar 2 at the top and the two lower reinforcing bars 3, 3 at the bottom. Those bars are placed above a base member 1. Two corrugated reinforcing bars 4, 4 each having a series of longitudinal triangular waves are rigidly secured to the upper reinforcing bar and to the lower reinforcing bars, respectively, in such a way that they form a triangular truss 5*b* extending transversely of the base member (FIG. 6). Each of the corrugated reinforcing bars 4, 4 includes top apex 4*b* and bottom apex 4*a*. The inside of the top apexes 4*b*, 4*b* may be rigidly secured to the sides of the upper reinforcing bar 2, respectively, and the predetermined intermediate part of each of the bars 4, 4 on its inside part between the top apex 4*b* and bottom apex 4*a* may be rigidly secured to the outer side of a respective one of the lower bars 3, 3 (FIG. 6).

Figure 8:
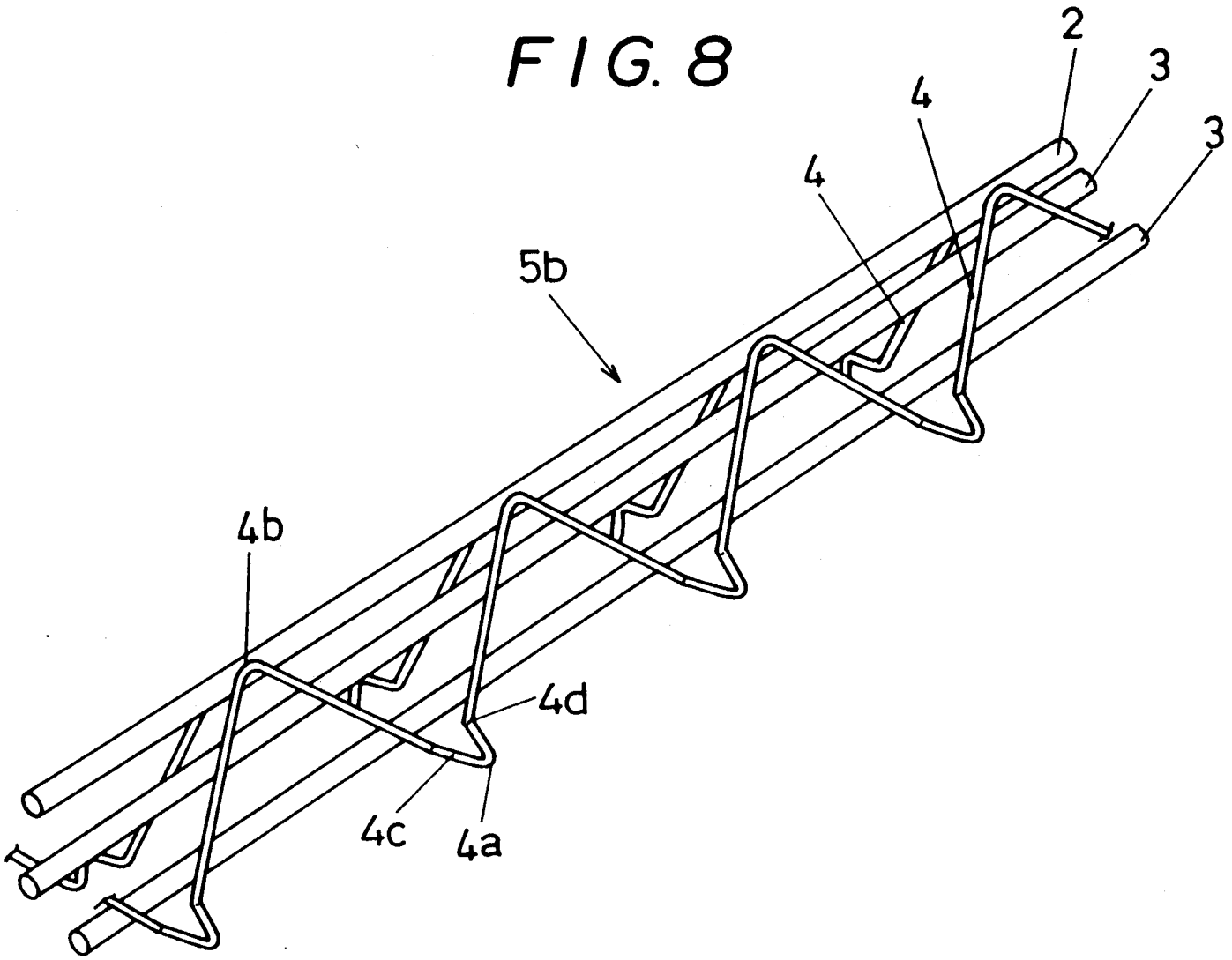
FIG. 8 is a perspective view of the embodiment of FIG. 6 with some parts omitted.
Figure 7:
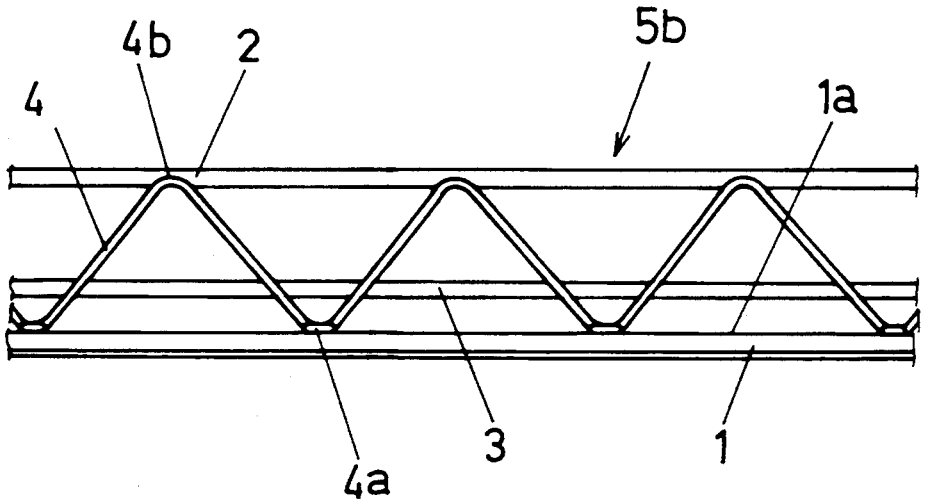
FIG. 7 is a front elevation of the embodiment of FIG. 6 with some parts omitted.

The corrugated reinforcing bars 4 is bent out at an intermediate part between the aforementioned position at which the inside of the bar 4 is secured to the outer side of the respective lower bar 3 and the bottom apex 4*a*, so the bottom apex 4*a* is extending outwardly from this bent out portion 4*d* (FIGS. 6 and 8). The bent out and outwardly extending portion 4*c* is bent and extended outwardly in a plane parallel with the surface 1*a* of base member 1, so the underside of the portion 4c can touch the surface 1a (FIG. 6).

Several trusses each having the identical construction as described above are erected on the base member 1 in parallel and at regular intervals along the length of the base member 1. Then, each of the trusses is rigidly secured to the base member 1 by securing the underside of portions 4c to the surface 1a. Thus, a deck plate 8b is completed (FIG. 6). All of the members may be joined together by means of welds, for example.

It may be seen that the bent out and outwardly extending portion 4c of the bar 4 is formed and bent to extend outwardly in the plane parallel with the surface 1a of the base member 1. In the alterative, the portion 4c may be formed and bent at any angle with respect to the surface 1a.

The deck plate 8b may be used in the same manner as described in connection with the preceding embodiment. The other features are the same as those for the preceding embodiment.

Figure 9:
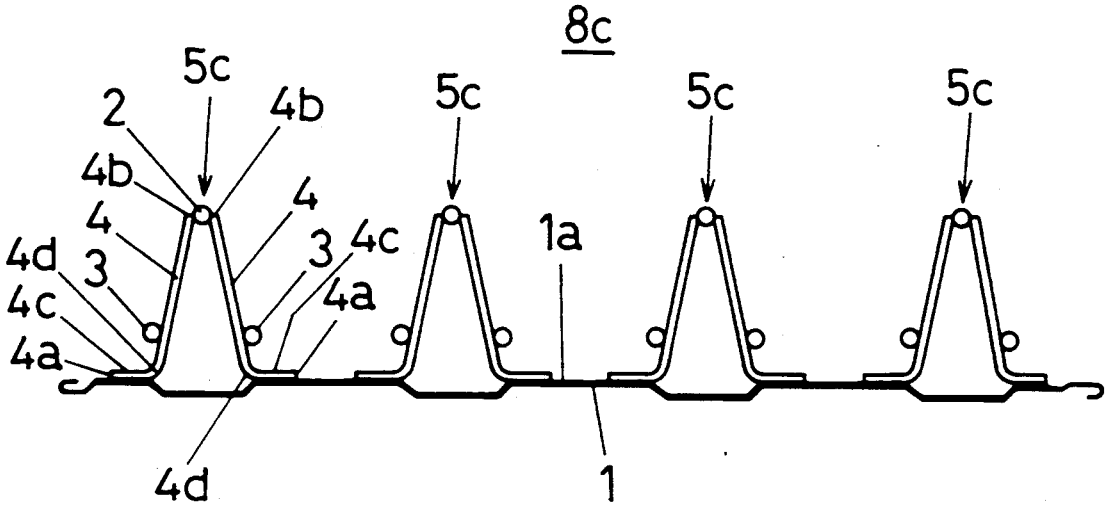
FIG. 9 is a side elevation of the fourth preferred embodiment of the present invention.

In the embodiment described so far, the truss 5b includes the corrugated reinforcing bars 4 rigidly secured to the outer side of the corresponding lower reinforcing bars 3. Alternatively, the corrugated reinforcing bars 4 may be rigidly secured to the inner side of the corresponding lower bars 3. In this case, a truss 5c and deck plate 8c are shown in FIG. 9.

In FIGS. 6 to 9, the same numeral is assigned to the same member of the deck plate as shown in FIGS. 1 to 5.

In the above-described embodiment, the trusses can stand independently on the base member, and so suspending members are not necessary.

(EXAMPLE 3)

Figure 10:
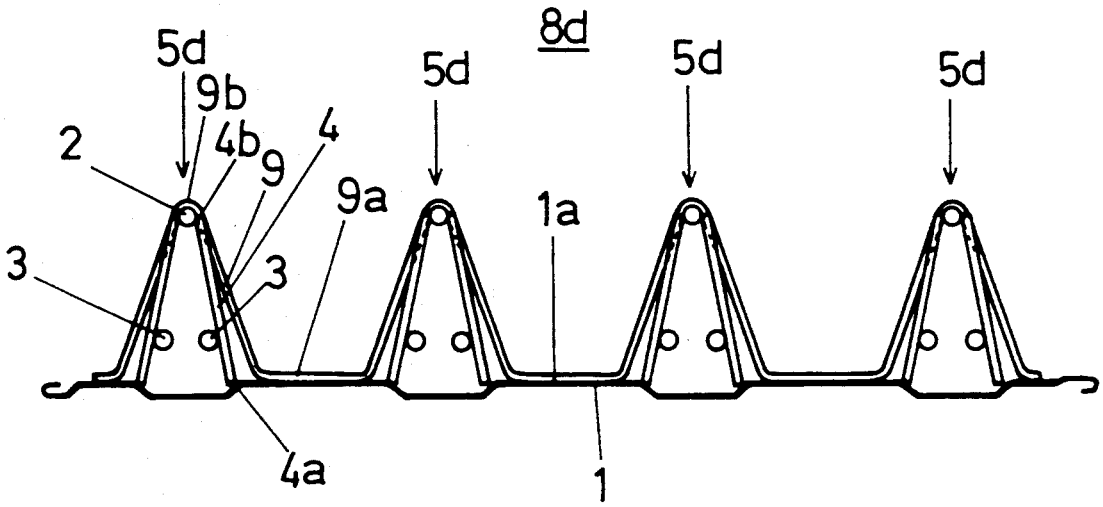
FIG. 10 is a side elevation of the fifth preferred embodiment of the present invention.
Figure 11:
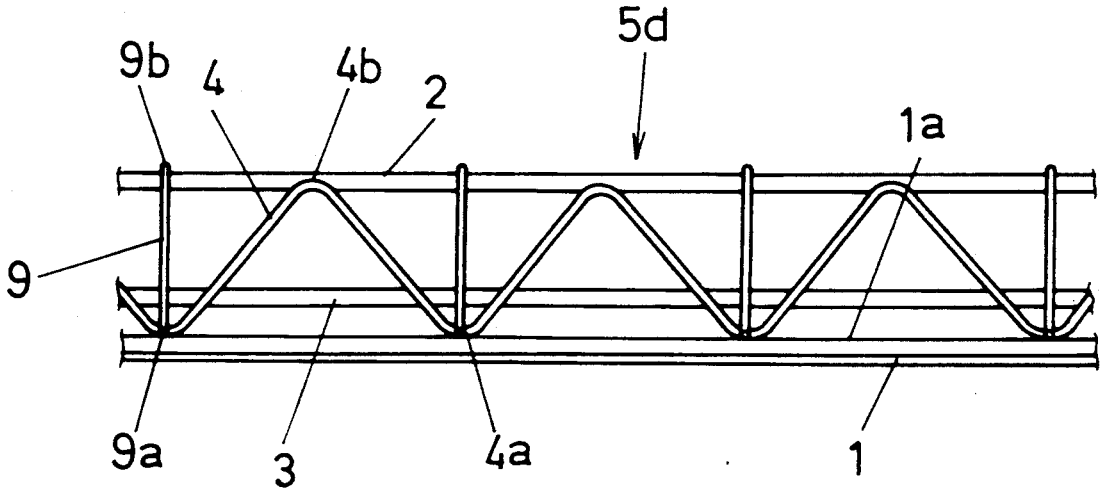
FIG. 11 is a front elevation of the embodiment of FIG. 10 with some parts omitted.
Figure 12:
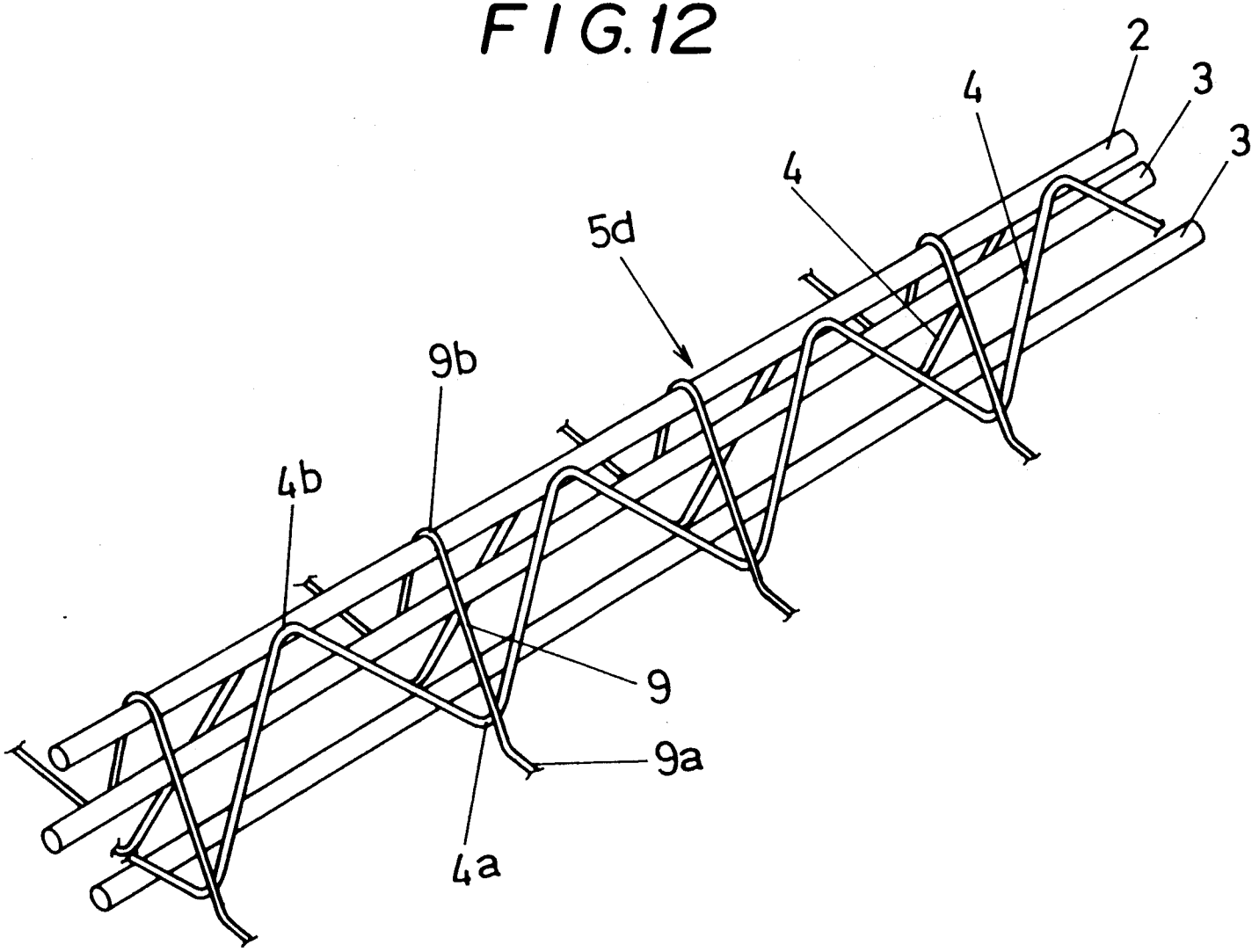
FIG. 12 is a perspective view of the embodiment of FIG. 10 with some parts omitted.

Referring next to FIG. 10 through FIG. 12, another preferred embodiment of the present invention will now be described.

The construction is generally similar to that in the preceding embodiments, and includes one upper reinforcing bar 2 and two lower reinforcing bars 3, 3 arranged in a triangle having the upper bar 2 at the top and the lower bars 3, 3 at the bottom. Those members are placed above a base member 1. Two corrugated reinforcing bars 4, 4 each having a series of longitudinal triangular waves are rigidly secured to the upper reinforcing bar and to the lower reinforcing bars, respectively, in such a way that they form a triangular truss 5d extend transversely (FIG. 10) of the base member. Each of the corrugated reinforcing bars 4, 4 includes a top apex 4b and a bottom apex 4a. The inside of the top apexes 4b, 4b may be rigidly secured to the sides of the upper reinforcing bar 2, respectively, and a predetermined intermediate part of each of the bars 4, 4 on its inside part between the top apex 4b and bottom apex 4a may be rigidly secured to the outer side of a respective one of the lower bars 3, 3 (FIG. 10). The predetermined intermediate part of the bar 4 on its inside part at which the inside of the bar 4 is secured to the outer side of a respective lower bar 3 is located 30 mm above the surface 1a of the base member 1, for example (FIGS. 10 and 11).

Several trusses each having the identical construction as described above are erected on the base member 1 parallel and at regular intervals along the length of the member 1 (FIG. 10).

Then a number of suspending reinforcing bars 9 having a triangular shape which corresponds to the triangular shape of the truss 5d formed by said upper reinforcing bar 2, two lower reinforcing bars 3, 3 and two corrugated reinforcing bars 4, 4 are placed onto the trusses 5d on the base member 1 and bridge across the trusses 5d. Those bars 9 are arranged at regular intervals along the length of the trusses 5d as shown in FIGS. 10 to 12. The underside of each of the top apexes 9b of the bars 9 is rigidly secured to the upper side of the upper reinforcing bar 2 of the truss 5d. And the underside of each part 9a of the bars 9 which touches the surface 1a of the base member 1 is rigidly secured to the surface 1a. In this way, the deck plate 8d is completed (FIG. 10). All of the members may be joined together by means of welds, for example.

The deck plate 8d may be used in the same manner as described in connection with the preceding embodiments. The other features are the same as those for the preceding embodiments.

Although the present invention has been described in full detail with reference to the several preferred embodiments, it should be understood that various changes and modifications may be made without departing from the spirit and scope of the invention as defined in the appended claims.

What is claimed is:

1. A deck plate comprising: a base member, a number of trusses extending parallel to one another and at regular intervals on said base member, and longitudinal reinforcing bars rigidly securing the trusses to the base member;

each of said trusses comprising:

an upper longitudinal reinforcing bar, two lower longitudinal reinforcing bars, said upper longitudinal reinforcing bar and said two lower longitudinal reinforcing bars being arranged in a triangle and extending transversely of the base member with the upper reinforcing bar at the top and the two lower reinforcing bars at the bottom of the triangle, a first longitudinal reinforcing bar having a series of longitudinal triangular waves and rigidly secured to said upper reinforcing bar and to one of said lower reinforcing bars with the inside of each of upper apexes of said first reinforcing bar being rigidly secured to one side of said upper reinforcing bar, and the outside of part of said first reinforcing bar intermediate its upper apex and bottom apex being rigidly secured to the inner side of one of said lower reinforcing bars, and a second longitudinal reinforcing bar having a series of longitudinal triangular waves and rigidly secured to said upper reinforcing bar and to the other said lower reinforcing bar with the inside of each of upper apexes of said second reinforcing bar being rigidly secured to the other side of said upper reinforcing bar, and the outside of part of said second reinforcing bar intermediate its upper apex and bottom apex being rigidly secured to the inner side of the other said lower reinforcing bar;

said base member having a number of grooves extending parallel and spaced at regular intervals in its surface in correspondence with a series of the bottom apexes of the first and second reinforcing bars of each truss;

said trusses extending upright on the surface of the base member parallel to one another and at regular intervals, each of the series of the bottom apexes of the first and second reinforcing bars of each truss being disposed in the corresponding grooves in the surface of the base member, and said longitudinal reinforcing bars acting as a weight on the trusses and on the base member by extending longitudinally across the longitudinal axes of the trusses at the portion where each bottom apex of the first reinforcing bar and corresponding bottom apex of the second reinforcing bar are disposed in the corresponding grooves in the surface of the base member so that the trusses are rigidly secured to the base member.

2. A deck plate comprising: a base member, and a number of trusses extending parallel to one another and at regular intervals on said base member, and rigidly secured to the base member;

each of said trusses comprising:

an upper longitudinal reinforcing bar, two lower longitudinal reinforcing bars, said upper longitudinal reinforcing bar and said two lower longitudinal reinforcing bars being arranged in a triangle and extending transversely of the base member with the upper reinforcing bar at the top and the two lower reinforcing bars at the bottom of the triangle, a first longitudinal reinforcing bar having a series of longitudinal triangular waves and rigidly secured to said upper reinforcing bar and to one of said lower reinforcing bars with the inside of each of upper apexes of said first reinforcing bar being rigidly secured to one side of said upper reinforcing bar, and the outside of part of said first reinforcing bar intermediate its upper apex and bottom apex being rigidly secured to the outer side of one of said lower reinforcing bars, and a second longitudinal reinforcing bar having a series of longitudinal triangular waves and rigidly secured to said upper reinforcing bar and to the other said lower reinforcing bar with the inside of each of upper apexes of said second reinforcing bar being rigidly secured to the other side of said upper reinforcing bar, and the outside of part of said second reinforcing bar intermediate its upper apex and bottom apex being rigidly secured to the outer side of the other said lower reinforcing bar;

said first and second reinforcing bars being bent at portions thereof intermediate the portions at which said first and second reinforcing bars are secured to the respective lower reinforcing bars and the bottom apexes, respectively, each of the bottom apexes of said first and second reinforcing bars being located outwardly of the bent portion; and said trusses extending upright on the surface of the base member parallel to one another and at regular intervals, and each of the undersides of the bent portions of said first and second longitudinal reinforcing bars being secured to the surface of said base member.

3. The deck plate as defined in claim 2, wherein each of said bottom apexes of said first and second reinforcing bars extend outwardly in a plane parallel to the surface of the base member.

4. A deck plate comprising: a base member, a number of trusses extending parallel to one another and at regular intervals on said base member, and a number of suspending reinforcing bars rigidly securing said trusses to the said base member;

each of said trusses comprising:

an upper longitudinal reinforcing bar, two lower longitudinal reinforcing bars, said upper longitudinal reinforcing bar and said two lower longitudinal reinforcing bars being arranged in a triangle and extending transversely of the base member with the upper reinforcing bar at the top and the two lower reinforcing bars at the bottom of the triangle, a first longitudinal reinforcing bar having a series of longitudinal triangular waves and rigidly secured to said upper reinforcing bar and to one of said lower reinforcing bars with the inside of each of upper apexes of said first reinforcing bar being rigidly secured to one side of said upper reinforcing bar, and the inside of part of said first reinforcing bar intermediate its upper apex and bottom apex being rigidly secured to the outer side of one of said lower reinforcing bars, and a second longitudinal reinforcing bar having a series of longitudinal triangular waves and rigidly secured to said upper reinforcing bar and to the other said lower reinforcing bar with the inside of each of upper apexes of said second reinforcing bar being rigidly secured to the other side of said upper reinforcing bar, and the inside of part of said second reinforcing bar intermediate its upper apex and bottom apex being rigidly secured to the outer side of the other said lower reinforcing bar;

each of said suspending reinforcing bars having a triangular shape which corresponds to the triangular shape of the truss formed by said upper and two lower longitudinal reinforcing bars and said first and second reinforcing bars; and said trusses extending upright on the surface of the base member parallel to one another and at regular intervals, said suspending reinforcing bars bridging across longitudinal axes of said trusses in parallel and at regular intervals, and each of said suspending reinforcing bars secured to said trusses and to the surface of said base member with said suspending reinforcing bars being rigidly secured to the upper longitudinal reinforcing bar of the trusses at the upper side of said upper longitudinal reinforcing bar and with said suspending reinforcing bars being rigidly secured to the surface of said base member.

* * * * *